United States Patent [19]

Yoneyama et al.

[11] 4,211,836

[45] Jul. 8, 1980

[54] METHOD FOR DISPERSING OIL-SOLUBLE PHOTOGRAPHIC ADDITIVES

[75] Inventors: Masakazu Yoneyama; Yasuo Mukunoki; Takeshi Mikami; Jun Sasaki, all of Minami-ashigara, Japan

[73] Assignee: Fuji Photo Film Co., Ltd., Minami-ashigara, Japan

[21] Appl. No.: 4,509

[22] Filed: Jan. 18, 1979

[30] Foreign Application Priority Data

Jan. 23, 1978 [JP] Japan ..... 53-6025

[51] Int. Cl.[2] ..... G03C 1/10; G03C 1/40

[52] U.S. Cl. ..... 430/449; 430/223; 430/224; 430/372; 430/377; 430/382; 430/512; 430/544; 430/546; 430/565; 430/569; 430/957; 430/958

[58] Field of Search ..... 96/100 R, 94 R, 114.5, 96/114.4, 95, 99, 96

[56] References Cited

U.S. PATENT DOCUMENTS

| | | | |
|---|---|---|---|
| 3,258,338 | 6/1966 | Claeys et al. | 96/114.4 |
| 3,287,134 | 11/1966 | Kainrath et al. | 96/100 |
| 3,676,137 | 7/1972 | Mizuki et al. | 96/100 |
| 3,860,425 | 1/1975 | Ono et al. | 96/114.5 |
| 4,015,990 | 4/1977 | Ishida et al. | 96/56 |

OTHER PUBLICATIONS

Geiger et al., Chemical Abstracts, vol. 81, 84406v, 1974.

Takahashi et al., Chemical Abstracts, vol. 82, 53041p, 1975.

*Primary Examiner*—Travis Brown

*Attorney, Agent, or Firm*—Sughrue, Rothwell, Mion, Zinn and Macpeak

[57] ABSTRACT

A method for dispersing oil-soluble photographic additives into a hydrophilic colloid composition is disclosed characterized by the use of lecithin in conjunction with an anionic surface active agent containing an $—SO_3M$ or $—OSO_3M$ moiety wherein M represents a cation and a hydrophobic group having 8 to 30 carbon atoms.

12 Claims, No Drawings

METHOD FOR DISPERSING OIL-SOLUBLE PHOTOGRAPHIC ADDITIVES

BACKGROUND OF THE INVENTION

1. Field of the Invention

The present invention relates to a method of blending oil-soluble photographic additives into a hydrophilic colloid layer and, in particular, to a method of dispersing oil-soluble photographic additives into a hydrophilic colloid composition or into water.

2. Description of the Prior Art

In the manufacture of a photographic silver halide emulsion layer or other hydrophilic colloid coatings, one must often blend water-insoluble or sparingly soluble compounds (hereinafter referred to as "oil-soluble photographic additives") in such coatings. If may further be required that such additives which are insoluble in the hydrophilic colloid vehicle be uniformly dispersed in the form of extremely fine particles.

A typical color photographic light-sensitive material is based on a silver halide emulsion, though other types of materials are known using various other kinds of light-sensitive components. Such silver halide color photographic materials comprise principally a support, a red-sensitive silver halide emulsion layer, a green-sensitive silver halide emulsion layer and a blue-sensitive silver halide emulsion layer, each provided on said support. Various arrangements and constructions of silver halide color photographic materials may be employed for different types of imaging processes including, for example, diffusion transfer color photography and silver dye bleach color photography. Mixed grain photographic products and multilayer products are also known.

A number of recent advances in color photographic technology have been brought about by the use of oil-soluble photographic additives, which are dissolved in substantially water-insoluble, low-volatile organic solvents (for example, high boiling point organic solvents) and then dispersed into a hydrophilic colloid aqueous solution with the aid of an anionic surface active agent as an emulsifier. Such oil-soluble photographic additives include oil protected couplers, UV absorbing agents, fade preventing agents, antioxidants, dye precursors for color diffusion transfer, dye developers, etc.

Various methods are known for emulsifying and dispersing such oil-soluble photographic additives including methods disclosed in U.S. Pat. Nos. 2,739,888, 3,352,681, etc., for dispersing UV absorbing agents; the methods disclosed in U.S. Pat. Nos. 2,360,290, 2,728,659, 3,700,453, etc., for dispersing diffusion-resistant alkylhydroquinones used for preventing dye fogging, staining and color mixing.

Usually, anionic surfactants are used to disperse oil-soluble photographic additives. For example, the method set forth in U.S. Pat. No. 2,332,027 employs Gardinol WA (a sulfonated coconut fatty alcohol, Du Pont de Nemours & Co.) and triisopropylnaphthalene-sulfonates. Japanese Pat. No. 428,191 discloses a method based on the use of water-soluble coupler containing a sulfonate or a carboxyl group together with a long-chain aliphatic group as an emulsifier. U.S. Pat. No. 3,676,141 describes a method relying upon a combination of an anionic surfactant containing a sulfonic group and a nonionic surfactant containing an anhydrohexyl ester unit.

In designing and fabricating a color photographic product, the light-sensitive coatings have finite thicknesses and the presence of incorporated additives in the form of coarse particles in the coatings can cause light scattering and deteriorate the transparency of the finished product. Furthermore, the image sharpness as well as the graininess of the photograph can be remarkably deteriorated. In contrast, when a coupler is dispersed in fine particles, the surface area per unit of weight of the coupler increases which in turn increases the rate and the efficiency of dye development, thus bringing about an improvement in the covering power of the resulting color image.

Accordingly, it is important that the growth of coarse particles during storage of an emulsified product be prevented. Emulsified products prepared by either of the methods cited above exhibit insufficient storage stability. In particular, when they were stored for an extended period of time at low temperatures, or for 24 hours at 40° C., the growth of coarse particles is unavoidable.

SUMMARY OF THE INVENTION

A principal object of the present invention is to provide an emulsion containing oil-soluble photographic additive with excellent stability such that aggregation of particles and crystal deposits under severe storage conditions such as at low or high temperatures does not occur.

Another object of the present invention is to provide an emulsion in which the growth or precipitation of coarse particles is prevented during storage.

Still a further object of the present invention is to provide an emulsion having extremely fine particle size.

Another object of the present invention is to provide a photographic emulsion having excellent storage stability.

DETAILED DESCRIPTION OF THE INVENTION

The above objects of the present invention have been achieved by dispersing a solution obtained by dissolving an oil-soluble photographic additive in at least one organic solvent or dispersing a liquid obtained by melting an oil-soluble photographic additive, into water or into a hydrophilic colloid composition in the presence of lecithin and an anionic surface active agent having a hydrophobic moiety containing 8 to 30 carbon atoms and an $—SO_3M$ or $—OSO_3M$ group wherein M represents a cation which can form a salt with the sulfonic or sulfuric acid moiety, including typically alkali metals, alkaline earth metals, ammonium ion or a quaternary ammonium ion. In the case that M represents an alkaline earth metal, the anionic surface active agent may take the form ([hydrophobic moiety]-$SO_3)_2M$ or ([hydrophobic moiety]-$OSO_3)_2M$.

The term "lecithin" as used with respect to the present invention is the product obtained as the acetone-insoluble ingredient resulting from the extraction with acetone of a wholly lipid mixture extracted from living matter, such as soybean, cattle liver, egg yolk, milk, indian corn, etc. Lecithin is a mixture of phospholipids and consists mainly of phosphatidylcholin which amounts to about 60 to 70% of the total phospholipid content. Other phospholipids which may be present include phosphatidylethanolamine, inositolphosphatide. Lecithin is a well known natural emulsifying agent which is free of toxic effects and is thus suited as an emulsifier for foodstuffs. Its effects as emulsifying agent are more or less determined by the other ingredients it is used in conjunction with.

That lecithin can also be quite effectively used to disperse photographic additives having a unique chemical structure has not been known. Attempts were made to disperse oil-soluble additives using various types of lecithin by itself, but did not produce emulsions stable enough that the incorporated additive would not separate out during storage or during the manufacture of the photographic product. Unexpectedly, however, it has been found that the combined use of a sulfonic acid or sulfate ester type anionic surfactant with lecithin produces a remarkably stable emulsion. In other words, the use of the anionic surfactant together with lecithin yields an emulsion of extremely fine particle size, which shows a very high stability upon storage over a very long period of time. The effect achieved far exceeds the effect achieved using the sulfonic acid or sulfate ester type anionic surfactant alone.

The anionic surfactant used in accordance with the present invention must have in its molecular structure a hydrophobic moiety containing 8 to 30 carbon atoms and an $—SO_3M$ or $—OSO_3M$ wherein M is defined as above. Hereinafter, such anionic surfactants will be referred to as "sulfonic acid type" and "sulfate type" anionic surfactants. These types of surfactant are described in *Synthesis and Application of Surface Active Agents*, authored by R. Oda and K. Teramura, published by Maki Publishing Co. (1960), and *Surface Active Agents*, authored by A. W. Perry (Interscience Publications, Inc., New York).

Examples of the above-cited anionic surface active agents are listed below.

| Compound No. | Surfactant |
|---|---|
| A-1 | $C_{12}H_{25}OSO_3Na$ |
| A-2 | $C_{14}H_{29}OSO_3Na$ |
| A-3 | Turkey red oil |
| A-4 | $C_{12}H_{25}CONHCH_2CH_2OSO_3Na$ |
| A-5 | $C_{12}H_{25}SO_3Na$ |
| A-6 | $C_{14}H_{29}SO_3Na$ |
| A-7 | 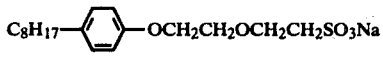 |
| A-8 | 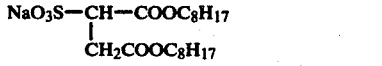 |
| A-9 | 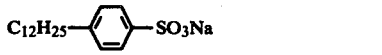 |
| A-10 | 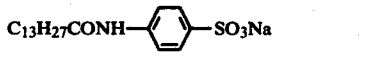 |
| A-11 | 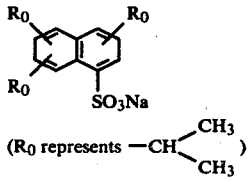 |
| A-12 | 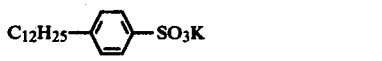 |
| A-13 | 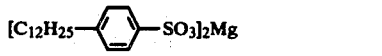 |

In this specification, the oil-soluble photographic additives are those additives which cannot be dissolved in water in amounts exceeding 3% by weight at room temperature (20° C.).

Oil-soluble photographic additives which can be emulsified and dispersed in accordance with the present invention include, for example, oil protected couplers, DIR colorless coupling compounds, UV light absorbing agents, fade preventing agents, antioxidants, dye precursors for color diffusion transfer, dye developers, etc.

The oil protected couplers to which the present invention can be applied are disclosed, for example, in the following patent specifications:

Yellow couplers characterized by an open chain diketomethylene compounds are disclosed in U.S. Pat. Nos. 3,341,331, 2,875,057, 3,551,155, 3,265,506, 3,582,322, 3,725,072, 3,369,895, 3,408,194 and 3,551,156, German Patent Application (OLS) Nos. 2,057,941, 2,162,899, 2,213,461, 2,219,917, 2,261,361 and 2,263,875.

Magenta couplers characterized by 5-pyrazolone derivatives, though indazolone and cyanoacetyl compounds can also be used, are described in U.S. Pat. Nos. 2,439,098, 2,600,788, 2,983,608, 3,062,653 and 3,558,319, British Pat. No. 956,261, U.S. Pat. Nos. 3,582,322, 3,615,506, 3,519,429, 3,311,476, 3,419,391 and 3,935,015, British Pat. Nos. 1,470,552 and 1,247,493, Belgian Pat. No. 664,221, Canadian Pat. No. 1,023,597, etc.

Cyan couplers which for the most part are characterized by phenol or naphthol derivatives are disclosed in U.S. Pat. Nos. 2,369,929, 2,474,293, 2,698,794, 2,895,826, 3,311,476, 3,458,315, 3,560,212, 3,582,322, 3,591,383, 2,434,272, 2,706,684, 3,034,892, 3,583,971 and 3,933,500, German Patent Application (OLS) No. 2,163,811, British Pat. No. 1,201,110, etc.

Other colored couplers which are oil-soluble photographic additives within the meaning of the present invention are disclosed, for example, in U.S. Pat. Nos. 3,476,560, 2,521,908 and 3,034,892, Japanese Patent Publication Nos. 2016/1969, 22335/1963, 11304/1967 and 32461/1969, Japanese Patent Application Nos. 98469/1974 and 118,029/1975, German Patent Application (OLS) No. 2,418,959, etc.

The present invention is also applicable to so-called DIR couplers which liberate a development inhibitor upon chromogenic reaction. Such couplers are disclosed in, for example, U.S. Pat. Nos. 3,227,554, 3,617,291, 3,701,783, 3,790,384 and 3,632,345, German Patent Application (OLS) Nos. 2,414,006, 2,454,301 and 2,454,329, British Pat Nos. 953,454 and 1,513,537.

Oil protected couplers to which the present invention is applicable include the yellow, magenta and cyan couplers, the colored couplers and the DIR couplers cited above.

The present invention is also applicable to DIR colorless coupling compounds. Such compounds include those disclosed in, for example, U.S. Pat. Nos. 3,297,445 and 3,379,529, and German Patent Application (OLS) No. 2,417,914, etc.

In order to meet the particular requirements of a specific photographic material, two or more of the couplers or compounds described above can be emulsified at the same time. The following are typical examples of oil-soluble compounds to which the present invention is applicable, however, the present invention can be used in conjunction with oil-soluble additives other than these.

Yellow Dye Forming Couplers:

-continued
Y-1
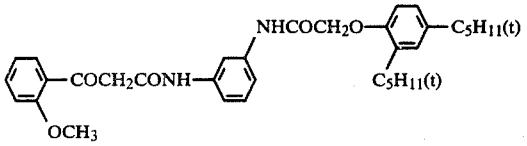
Y-2
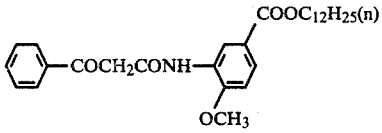
Y-3
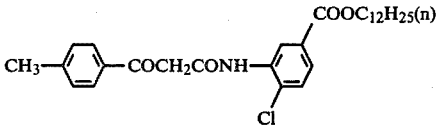
Y-4
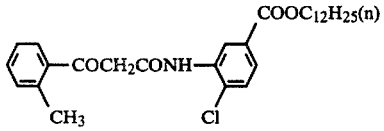
Y-5
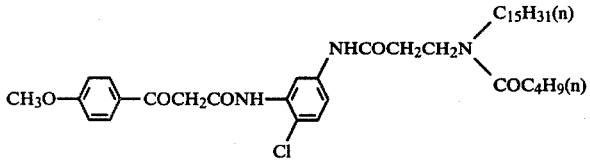
Y-6
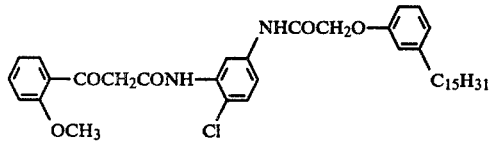
Y-7
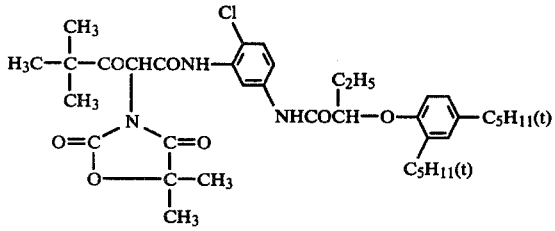
Magenta Dye Forming Couplers:
M-1
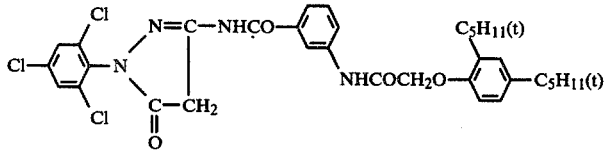
M-2
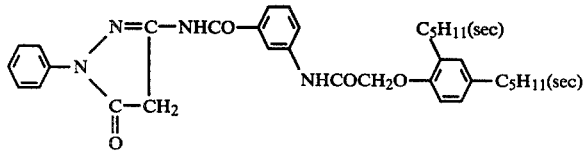
M-3
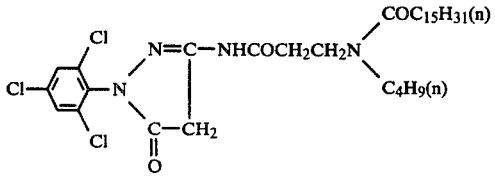

-continued
M-4
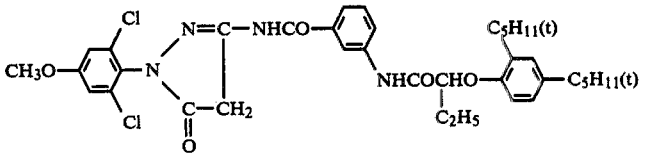
M-5
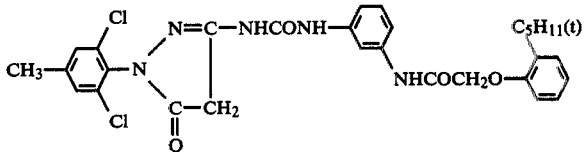
M-6
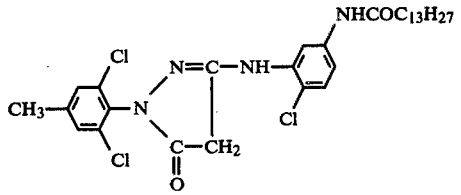
Cyan Dye Forming Couplers:
C-1
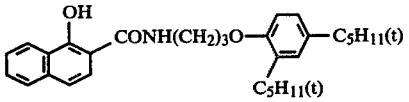
C-2
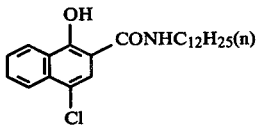
C-3
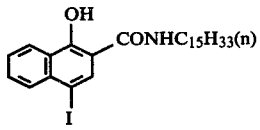
C-4
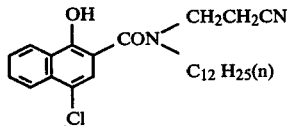
C-5
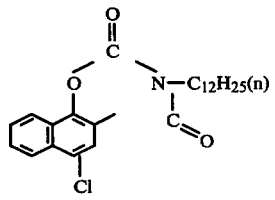
C-6
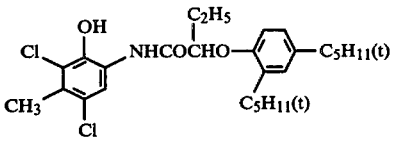
Mask Forming Colored Couplers:
L-1
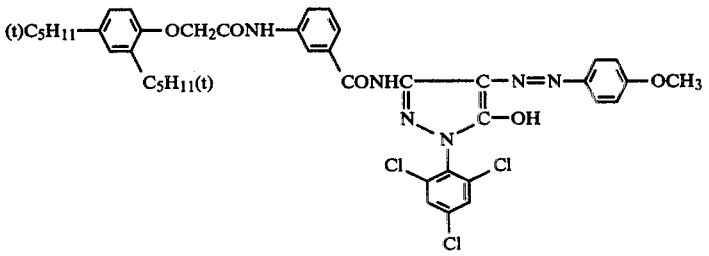

-continued
L-2
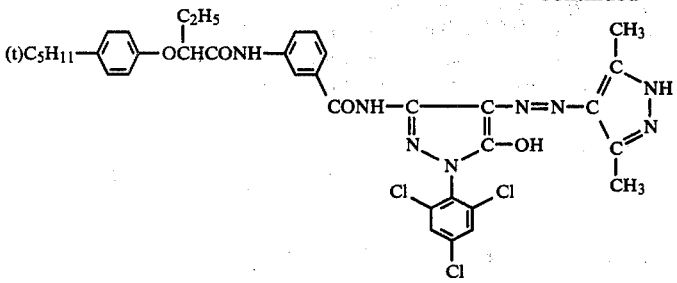
L-3
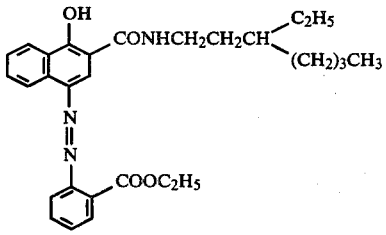
L-4
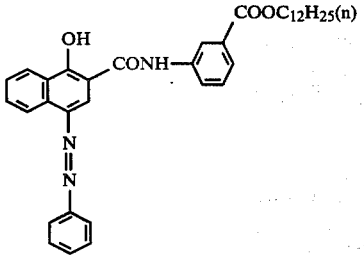
DIR Couplers (Development Inhibitor Releasing Coupler):
N-1
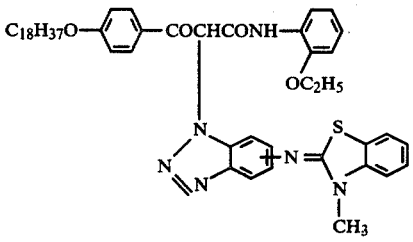
N-2
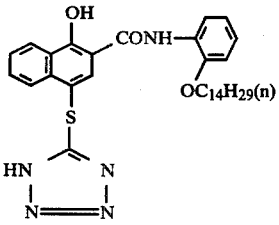
N-3
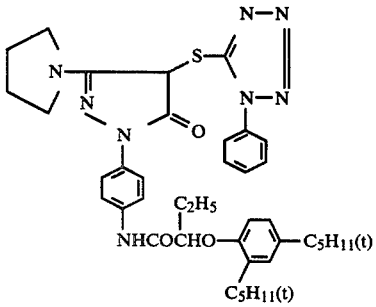
Oil-soluble UV absorbing agents which can be used in conjunction with the present invention include those set forth in, for example, U.S. Pat. Nos. 3,533,794 and 3,794,493, British Pat. No. 1,293,982, etc.
Several exemplary compounds of such oil-soluble UV absorbing agents are illustrated below.

U-1

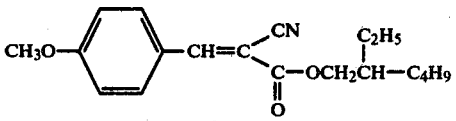

U-2

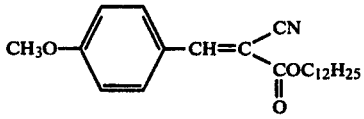

U-3

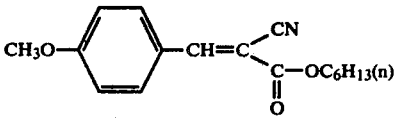

U-4

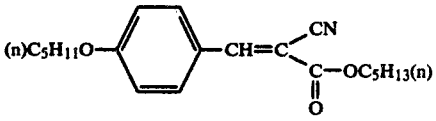

U-5

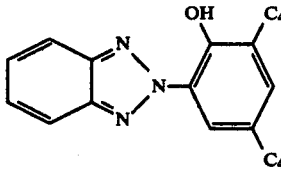

U-6

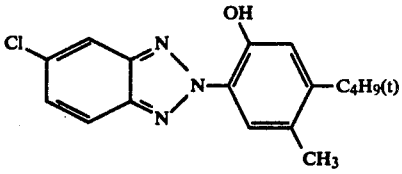

U-7

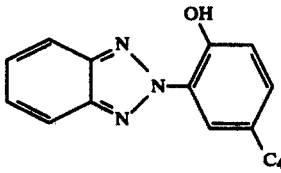

The method of the present invention can also be applied to oil-soluble antioxidants such as are set forth in U.S. Pat. Nos. 2,336,327, 2,728,659 and 2,835,579, Japanese Patent Application (OPI) No. 2128/1971, etc. Some oil-soluble antioxidants are exemplified below:

AO-1

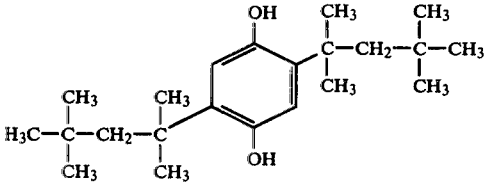

AO-2

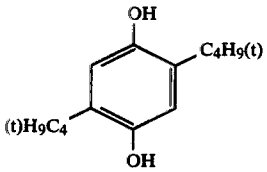

Fade preventing agents for the finished dye image to which the present invention is applicable include those set forth in, for example, Belgian Pat. No. 777,487, German Pat. No. 1,547,684, German Patent Application (OLS) No. 2,146,668, etc.

Oil-soluble dye precursors to which the present invention is applicable and which can be employed in diffusion transfer color photographic elements include, for example, dye releasing redox compounds set forth in U.S. Pat. Nos. 3,929,760, 3,932,381, 3,942,987, 3,954,476, 3,993,638, 4,013,635, 4,055,428 and 4,076,529. Examples are shown below.

DR-1

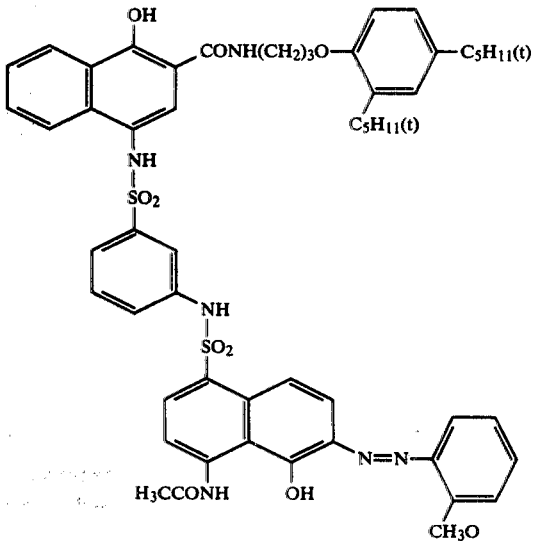

-continued

DR-2

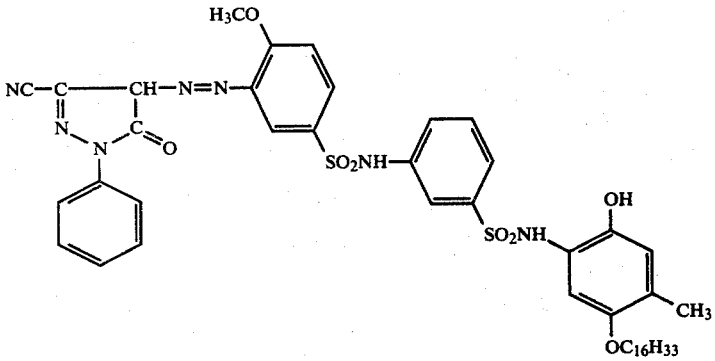

DR-3

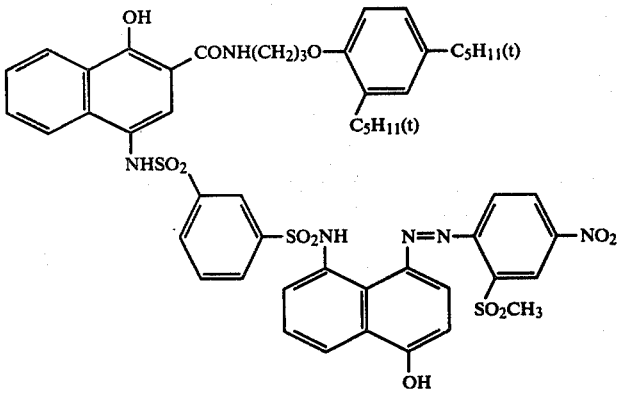

DR-4

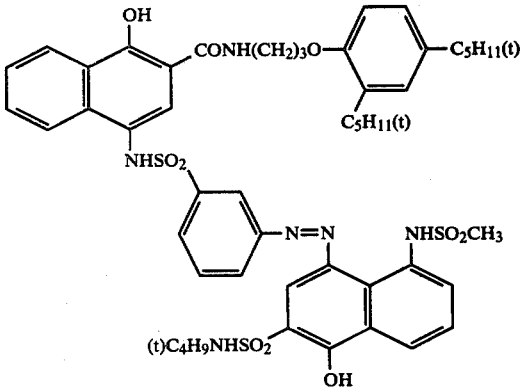

DR-5

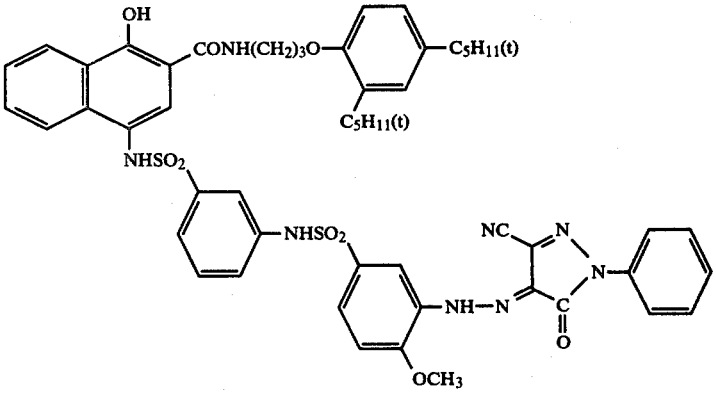

Furthermore, the present invention can be used in conjunction with compounds releasing dyes upon coupling reaction as set forth in British Pat. Nos. 840,731, 904,364, 904,365 and 1,038,331, U.S. Pat. Nos. 3,227,551 and 3,327,554, etc., those compounds that can provide dyestuffs upon coupling reaction and those are set forth in British Pat. Nos. 840,731 and 904,364, U.S. Pat. Nos. 3,227,551 and 3,227,554, etc., and dye developers set forth in U.S. Pat. Nos. 3,415,644, 3,415,645, 3,415,646, 3,594,164 and 3,594,165.

Some exemplary dye developers to which the present invention is applicable are illustrated below.

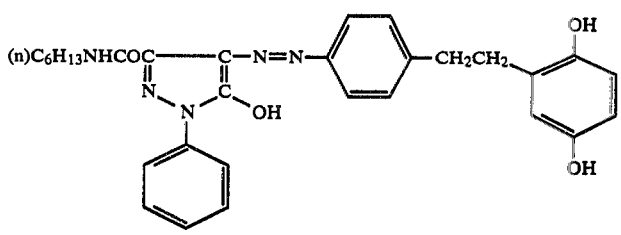

DD-1

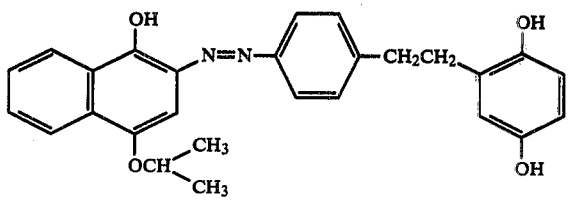

DD-2

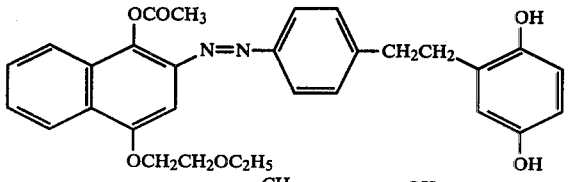

DD-3

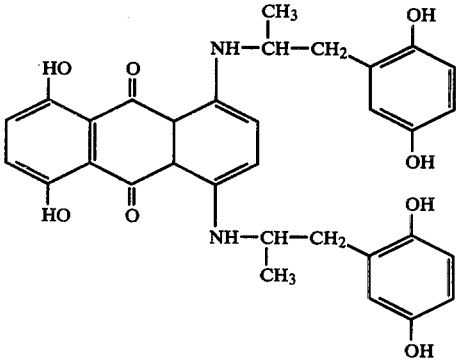

DD-4

In practicing the method of the present invention, the oil-soluble photographic additive must be melted or fused by heat or dissolved in an organic solvent prior to emulsification. Only additives that have a melting point below about 90° C. can be emulsified directly through thermal fusion.

The organic solvents used to finely disperse the oil-soluble photographic additive in the aqueous medium (to provide an oily phase) are preferably substantially immiscible in water and have a boiling point of at least 190° C. at atmospheric pressure.

Such low-volatile organic solvents are described, for example, in U.S. Pat. Nos. 2,322,027, 2,353,262, 2,533,514, 2,835,579, 2,852,383, 3,256,658, 3,287,134, 3,554,755, 3,676,137, 3,676,142, 3,700,454, 3,748,141, 3,837,863, 3,936,303 and 4,004,928, British Pat. Nos. 958,441, 1,222,753, 1,357,372 and 1,501,223, German Patent Application (OLS) No. 2,538,889, Japanese Patent Application (OPI) Nos. 26037/1976 (The term "OPI" as used herein refers to a "published unexamined Japanese patent application"), 27921/1976, 62632/1975 and 82078/1975, Japanese Patent Publication No. 29461/1974, etc.

Low-volatile organic solvents advantageously used in the present invention include esters (e.g., phthalates, phosphates, citrates, benzoates, fatty acid esters, carbonates, etc.), amides (e.g., fatty acid amides, sulfonamides, etc.), ethers (e.g., allyl esters, etc.), alcohols, paraffins, etc. Most preferably used are high boiling organic solvents, for example, phthalate esters (e.g., dibutyl phthalate, dihexyl phthalate, diheptyl phthalate, dioctyl phthalate, dinonyl phthalate, didecyl phthalate, butylphthalylbutyl glycolate, dibutyl monochlorophthalate, etc.), phosphoric acid esters (e.g., tricresyl phosphate, trixylelyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate, etc.), citric acid esters (e.g., o-acetyltriethyl (or butyl, hexyl, octyl, nonyl, decyl) citrate, triethyl (or butyl, hexyl, octyl, nonyl, decyl, tridecyl) citrate, etc.), benzoic acid esters (e.g., butyl (or hexyl, heptyl, octyl, nonyl, decyl, dodecyl, tridecyl, tetradecyl, hexadecyl, octadecyl, oleyl, etc.) benzoate, pentyl o-mehylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate, etc.) fatty acid esters (e.g., hexadecyl milistate, dibutoxyethyl succinate, dioctyl adipate, dioctyl azelate, decamethylene-1,10-diol diacetate, triacetin, tributin, benzyl caprate, pentaerythritol tetracaproate, isosorbide dicaprylate, etc.), amides (e.g., N,N-dimethyllauramide, N,N-diethylcaprylamide, N-butylbenzenesulfonamide, etc.), trioctyl trimellitate, chlorinated paraffin, etc.

Occasionally in the practice of the present invention, it is advantageous to employ, together with a low volatile (high boiling) solvent cited above, a volatile or low boiling point solvent (having a boiling point not exceeding 130° C.) or a low volatile water-miscible solvent to dissolve the oil-soluble photographic additive. Such a water-miscible high boiling point solvents or volatile solvent include, for example, propylene carbonate, ethyl acetate, butyl acetate, ethyl propionate, sec-butyl alcohol, tetrahydrofuran, cyclohexanone, dimethylformamide, diethyl sulfoxide, methyl cellosolve, carbinol, etc.

The emulsifying apparatus used to practice the present invention should preferably be such as to be able to impart a large stress on the liquid to be treated, or to transmit ultrasonic energy of high intensity. Suitable apparatuses include a colloid mill, a homogenizer, a microporous emulsifier, a liquid siren, an electromagnetic strain type ultrasonic generator, and an emulsifier provided with Pollmann's whistle.

The lecithin and surfactant are used in combination in amounts which are sufficient to disperse the oil-soluble additive in water or hydrophilic colloid. A suitable concentration range for the lecithin and the anionic surfactant (each) used in the present invention depends on the type of the oil-soluble photographic additive to be dispersed (e.g., coupler. UV absorber, antioxidant, dye precursor for diffusion transfer color process, etc.), the kind and the amount of the dispersing solvent, the species and the amount of any other coexisting surfactants, and the type of the resulting color photographic product but is usually about 0.5 to 50% by weight based on the weight of the solution obtained by dissolving the oil-soluble photographic additive in the dispersing solvent. When the oil-soluble photographic additive is melted or fused, a suitable amount of lecithin is about 0.5 to about 50% by weight based on the weight of the liquid obtained by melting the additive and a suitable amount of the surface active agent is about 0.5 to about 50% by weight based on the weight of the liquid. In either case, a suitable weight ratio for the amount of lecithin to the amount of the surface active agent is about 0.1 to about 10, preferably 0.5 to 2.

The oil-soluble photographic additive can be dispersed into either water or a hydrophilic colloid composition in the present invention, and the present invention is particularly suited for the latter.

Lecithin and/or the anionic surfactant can be present either in the organic solvent or in the aqueous or hydrophilic colloidal phase at the initial stage, giving substantially similar results in either case. A suitable temperature for preparing the dispersion is a temperature which is not too close to the boiling point of the solvent when a low boiling point solvent is used. Temperatures below about 95° C. are conveniently used when a low boiling solvent is employed.

In many embodiments of the present invention, the hydrophilic colloid in the composition is a binder or protective colloid for the silver halide grains contained in silver halide photographic products.

In practicing the present invention, one can remove the volatile solvents employed in order to improve the stability of the resulting emulsion. Further, to enhance the dispersion stability, one can incorporate a latex or an emulsion of a synthetic polymeric material which is substantially insoluble or sparingly soluble in water into the finished dispersion of the oil-soluble photographic additive prepared in accordance with the present invention.

Gelatin is most preferably used as binder or protective colloid in the present invention, though, of course, other hydrophilic colloids may also be used. Other suitable hydrophilic materials include, for example, gelatin derivatives, graft copolymers comprising gelatin and other polymeric materials, albumin, casein and other forms of protein, cellulose derivatives such as hydroxyethyl cellulose, carboxymethyl cellulose, the sulfuric acid ester of cellulose, etc., carbohydrate derivatives such as sodium alginate, starch and its derivatives, etc., various synthetic polymer materials such as poly(vinyl alcohol), partially acetalized poly(vinyl alcohol), poly-N-vinylpyrrolidone, poly(acrylic acid), poly(methacrylic acid), polyacrylamide, polyvinylimidazole, polyvinylpyrazole, etc., and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme. Suitable gelatin derivatives include the reaction products obtained by subjecting gelatin to reactions with a number of reagents such as acid halide, acid anhydride, isocyanate, bromoacetic acid, alkane sultone, vinylsulfonamide, maleinimide, polyalkylene oxide, epoxide, etc. Reference can be made to U.S. Pat. Nos. 2,614,928, 3,132,945, 3,186,846 and 3,312,553, British Pat. Nos. 861,414, 1,033,189 and 1,005,784, Japanese Patent Publication No. 26845/1967, etc.

Suitable graft polymer chains to gelatin include acrylic acid, methacrylic acid, acrylate and methacrylate ester, acrylamide or methacrylamide, acrylonitrile, styrene and other vinyl monomers. Preferable graft polymers are those with a certain extent of compatibility with gelatin, comprising acrylic and methacrylic acid, acrylamide and methacrylamide, hydroxyalkylmethacrylate, etc. Related compounds are described in U.S. Pat. Nos. 2,763,625, 2,831,767 and 2,956,884, etc.

Representative hydrophilic synthetic polymeric materials include those described in, for example, German Patent Application (OLS) No. 2,312,708, U.S. Pat. Nos. 3,620,751 and 3,879,205, Japanese Patent Publication No. 7561/1968.

The prominent features and effects of the present invention will now be explained in more detail.

By practicing the present invention, one can disperse finely and very stably oil-soluble photographic additives such as an oil-soluble coupler, an oil-soluble UV absorbing agent, an oil-soluble antioxidant and an oil-soluble dye precursor without deteriorating the photographic performance of the final product and also without the tendency of particle agglomeration or separation of recrystallized deposit. Further, by using the dispersion prepared in accordance with the present invention, one can produce a photographic light-sensitive product which precipitates no crystalline product after the coating and drying of the dispersion.

Most of the emusifying agents conventionally used in the photographic art are generally more or less hygroscopic and tend to deteriorate the physical properties of the film on the surface of the product. This fact leads to an unacceptably sticky surface and an increase in the amount of the emulsifier used. By contrast, the combination of the emulsifiers characterizing the present invention exhibits a high degree of emulsifying capability, and a relatively small amount is required, thus the above-cited drawbacks are avoided.

EXAMPLE 1

20 g of the cyan coupler C-1 with the following chemical structure

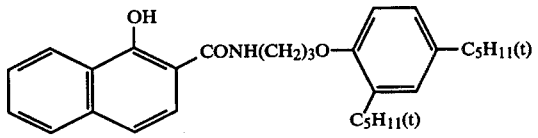

was dissolved together with 1 g of lecithin extracted from soybean into a mixture consisting of 20 g di-n-butyl phthalate and 60 g ethyl acetate with heating at 65° C. The resulting coupler solution was added to 250 g of a 10% gelatin aqueous solution containing 1.0 g sodium dodecylbenzenesulfonate at 50° C. The mixture was then agitated by means of high-speed homogenizer for 20 minutes to provide Emulsion A, which was passed through a rotary evaporator to remove the ethyl acetate. The mean particle size of the dispersed phase in this emulsion was 0.10 micron.

For the purpose of comparison, Emulsion B was prepared in the same manner except that lecithin was eliminated. The mean particle size was 0.11 micron.

A third emulsion, Emulsion C, was prepared for comparison by repeating the steps in the preparation of Emulsion A but with the removal of sodium dodecylbenzenesulfonate. The particle size immediately after the preparation was 2.2 microns on average.

The three emulsions thus prepared were compared for storage stability by slowly agitating at 40° C. The change in the particle size was traced with time to give the results shown in Table 1. While in the comparative emulsion samples the particles grow in size, the emulsion prepared according to the present invention showed very small change in particle size over a 24 hour period. It is evident that the emulsion has a marked stability and that this is due to the excellent emulsifier characteristic of the present invention. By the way, in Emulsion C which contained, as a sole emulsifier, lecithin, coarse droplets generated in 24 hours, manifesting the instability of the dispersion.

TABLE 1

| Emulsion | Mean Particle Size in Micron | | |
|---|---|---|---|
| | Just after Preparation | After 6 Hours | After 24 Hours |
| A (an embodiment of the invention) | 0.10 | 0.12 | 0.13 |
| B (comparative) | 0.11 | 0.28 | 0.33 |
| C (comparative) | 2.2 | 4.3 | very coarse |

TABLE 1-continued

EXAMPLE 2

20 g of Coupler C-1 was dissolved into a mixture consisting of 20 g di-n-butyl phthalate and 60 g ethyl acetate by heating to 65° C. The resulting solution was added while stirring to 250 g of a 10% aqueous gelatin solution containing 1.0 g lecithin extracted from egg yolk and 1.0 g sodium dodecylbenzenesulfonate at 50° C. The mixture thus-obtained was emulsified by means of high-speed agitating homogenizer for 20 minutes. The ethyl acetate was removed from the resulting emulsion by rotary evaporator.

The mean particle size in this emulsion designated Emulsion D was 0.11 micron immediately after the preparation.

The storage stability of the emulsion was tested in the same manner as in Example 1. The results are shown in Table 2.

TABLE 2

| Emulsion | Mean Particle Size in Micron | | |
|---|---|---|---|
| | Just after Preparation | After 6 Hours | After 24 Hours |
| Emulsion D (the present invention) | 0.11 | 0.11 | 0.13 |

By comparing the results in the two tables, one can conclude that the lecithin extracted from egg yolk is just as effective as that from soybean.

EXAMPLE 3

Yellow coupler of the following structure (Y-5):

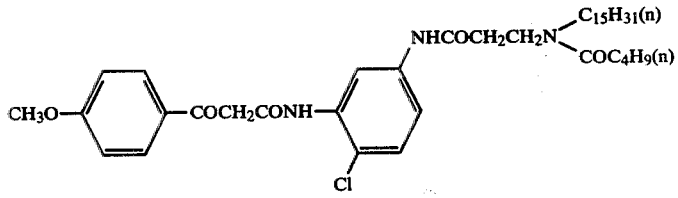

was dissolved in an amount of 40 g together with 1.5 g lecithin extracted from soybean to a mixture comprising 20 g di-n-butyl phthalate, 20 g tricresyl phosphate and 80 g ethyl acetate heated to 65° C. The coupler solution thus-prepared was introduced with agitation to 100 g of a 10% gelatin aqueous solution containing 1 g dioctyl sulfosuccinate at 50° C. And the resulting mixture was emulsified in a high-speed agitating homogenizer for 20 minutes to provide Emulsion E, from which the ethyl acetate was removed by a rotary evaporator. The particles dispersed in this emulsion E had a mean diameter of 0.15 micron.

Another comparative emulsion, Sample F, was prepared using the same ingredients and by the same procedures except that lecithin was excluded. In this emulsion, the mean particle size was 0.16 micron.

The two emulsions were cooled to gel, and kept at 5° C. After storage for 15 and 30 days at this temperature, each emulsion was subjected to particle size measurement. The results are shown in Table 3, which demonstrate the gradual growth of particles in Emulsion F with the lapse of time, while in Emulsion E (prepared in accordance with the present invention) substantially no change in particle size is observed during the storage at low temperature for 30 days. Again the excellent stability of the emulsion prepared in accordance with the present invention is proved.

TABLE 3

| Emulsion | Mean Particle Size in Micron | | |
|---|---|---|---|
| | Just after Preparation | After 15 Days | After 30 Days |
| E (the present invention) | 0.15 | 0.15 | 0.16 |
| F (comparative sample) | 0.16 | 0.19 | 0.27 |

While the invention has been described in detail and with reference to specific embodiments thereof, it will be apparent to one skilled in the art that various changes and modifications can be made therein without departing from the spirit and scope thereof.

What is claimed is:

1. A method for dispersing an oil-soluble photographic additive into water or a hydrophilic colloid wherein a solution of an oil-soluble photographic additive in an organic solvent which is substantially immiscible in water and has a boiling point of at least 190° C. at atmospheric pressure is dispersed in water or a hydrophilic colloid in the presence of lecithin together with an anionic surface active agent having in its molecular structure a hydrophobic moiety containing from 8 to 30 carbon atoms and an —$SO_3M$ or —$OSO_3M$ group wherein M represents a cation capable of forming a salt with the sulfonic or sulfuric acid moiety.

2. The method of claim 1, wherein said additive is an oil-soluble photographic color coupler.

3. The method of claim 1, wherein said additive is an oil-soluble dye developer.

4. The method of claim 1, wherein said hydrophilic colloid contains gelatin.

5. The method of claim 1, wherein said hydrophilic colloid is a silver halide emulsion.

6. The method of claim 1, wherein said additive is dissolved in an organic solvent and dispersed in a hydrophilic colloid.

7. The method of claim 6, wherein said lecithin and said surfactant are present in the solution of said additive.

8. The method of claim 1, wherein said additive is dispersed in a hydrophilic colloid and said lecithin and said surfactant are added to said colloid.

9. The method of claim 6, wherein said solvent is substantially immiscible in water and has a boiling point of at least 190° C. at atmospheric pressure.

10. The method of claim 9, wherein in addition to said solvent a solvent having a boiling point less than 130° C. is present.

11. The method of claim 1, wherein the weight ratio of lecithin to the surface active agent is about 0.1 to 10.

12. The method of claim 1, wherein the amount of lecithin is about 0.5 to 50% by weight based on the weight of said solution or said melt and the amount of surfactant is about 0.5 to 50% by weight based on the weight of said solution.

* * * * *